US008268760B2

(12) United States Patent
Habeeb et al.

(10) Patent No.: US 8,268,760 B2
(45) **Date of Patent: *Sep. 18, 2012**

(54) METHOD FOR REDUCING FRICTION/WEAR OF FORMULATED LUBRICATING OILS BY USE OF IONIC LIQUIDS AS ANTI-FRICTION/ANTI-WEAR ADDITIVES

(75) Inventors: Jacob Joseph Habeeb, Westfield, NJ (US); Jessica Lee Prince, Woodbury, NJ (US); Michael Eugene Landis, Mullica Hill, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 280 days.

This patent is subject to a terminal disclaimer.

(21) Appl. No.: 12/658,563

(22) Filed: Feb. 5, 2010

(65) Prior Publication Data

US 2010/0227783 A1 Sep. 9, 2010

Related U.S. Application Data

(60) Provisional application No. 61/208,165, filed on Feb. 20, 2009.

(51) Int. Cl.

| | |
|---|---|
| ***C10M 141/10*** | (2006.01) |
| ***C10M 133/04*** | (2006.01) |
| ***C10M 137/10*** | (2006.01) |
| ***C10M 135/18*** | (2006.01) |
| ***C07C 317/22*** | (2006.01) |
| ***C07D 207/26*** | (2006.01) |

(52) U.S. Cl. ..... 508/262; 508/244; 508/268; 508/279; 508/283; 508/302; 508/370; 508/433; 508/443

(58) Field of Classification Search ..... 508/262, 508/244, 268, 279, 283, 302, 370, 433, 443
See application file for complete search history.

(56) References Cited

U.S. PATENT DOCUMENTS

| | | | | |
|---|---|---|---|---|
| 4,108,858 | A | 8/1978 | Malec | |
| 4,326,973 | A | 4/1982 | Hammond et al. | |
| 4,747,971 | A | 5/1988 | Erdman | |
| 2006/0270568 | A1 | 11/2006 | Kawata et al. | |
| 2007/0027038 | A1 | 2/2007 | Kamimura et al. | |
| 2008/0119376 | A1 | 5/2008 | Devlin et al. | |
| 2009/0036334 | A1 | 2/2009 | Schwab et al. | |
| 2009/0069204 | A1 * | 3/2009 | Kamimura et al. | 508/100 |
| 2009/0270286 | A1 | 10/2009 | Kawata et al. | |
| 2010/0187481 | A1 | 7/2010 | Bodesheim et al. | |

FOREIGN PATENT DOCUMENTS

| | | | |
|---|---|---|---|
| CA | 2638146 | | 3/2007 |
| CA | 2687498 | | 12/2008 |
| DE | 102007028427 | | 12/2008 |
| EP | 1672051 | | 10/2004 |
| EP | 2022840 | | 7/2008 |
| JP | 2005089667 | A * | 4/2005 |
| JP | 2006/321856 | | 11/2006 |
| WO | 2007020468 | | 2/2007 |
| WO | 2007/055324 | | 5/2007 |
| WO | 2007128740 | | 11/2007 |
| WO | 2008075016 | | 6/2008 |
| WO | 2008154998 | | 12/2008 |
| WO | 2010096168 | | 8/2010 |
| WO | 2010096169 | | 8/2010 |

OTHER PUBLICATIONS

U.S. Appl. No. 12/658,564, Habeeb.
U.S. Appl. No. 12/658,565, Habeeb et al.
Minami et al., "Thermo-Oxidative Stability of Ionic Liquids as Lubricating Fluids", Journal of Synthetic Lubrication, vol. 24, Jun. 28, 2007, pp. 135-147.
Jimenez, A. E. et al., "Room Temperature Ionic Liquids as Lubricant Additives in Steel-Aluminum Contacts: Influence of Sliding Velocity, Normal Load and Temperature", J. Wear, vol. 261, No. 3-4, Aug. 30, 2006, pp. 347-359.

* cited by examiner

*Primary Examiner* — Prem C Singh
*Assistant Examiner* — Vishal Vasisth
(74) *Attorney, Agent, or Firm* — Robert A. Migliorini

(57) ABSTRACT

The anti-wear and anti-friction performance of a lubricating oil is improved by the addition thereto of an additive amount of ionic liquids.

9 Claims, No Drawings

METHOD FOR REDUCING FRICTION/WEAR OF FORMULATED LUBRICATING OILS BY USE OF IONIC LIQUIDS AS ANTI-FRICTION/ANTI-WEAR ADDITIVES

CROSS-REFERENCE TO RELATED APPLICATIONS

This is a Non-Provisional Application that claims priority to U.S. Provisional Application No. 61/208,165 filed Feb. 20, 2009, which is herein incorporated by reference in its entirety.

BACKGROUND OF THE INVENTION

1. Field of the Invention

The present invention relates to the reduction of friction and wear in engines lubricated with formulated lubricating oils by the use of additives.

2. Description of the Related Art

Ionic liquids which are low melting point salts comprising an anion and a cation have been of interest for lubrication applications because of their nonvolatility, nonflammability and thermal, mechanical and electrochemical stability.

US2007/0027038 is directed to a lubricant comprising, as the base oil, an ionic liquid formed of an anion and a cation and having an ion concentration of 1 mol/dm$^3$ or more. In describing the ionic liquids as base oils per se, the reference goes into extensive detail in discussing the anion and cation components, and indicates the need for the ionic liquid system to be substantially water-free to avoid undesirable corrosivity and loss in viscosity. The reference identifies imidazolium, pyridinium, alkylammonium among others as suitable, useful cations and $BF_4^-$ and $PF_6^-$ among numerous suitable anions. Materials such as alkylpyridinium hexafluorophosphate, alkylammonium tetrafluoroborate, among others are disclosed as being suitable for use as lubricating base fluids per se. Any of the ionic liquids embraced by the reference can be used in combination with various additives and may also be used in combination with mineral oils and synthetic oils. The reference goes on to recite that the "physical properties of ionic liquids are difficult to predict from the molecular structure thereof, and properties such as viscosity, viscosity index and pour point cannot readily be controlled through modification of the molecular structure." (Para. [0007].)

U.S. Pat. No. 4,108,858 teaches the addition of high molecular weight N-hydrocarbyl substituted quaternary ammonium salts (hydrocarbon component molecular weight from 350 to 3000) as dispersants and detergents. The cation in '858 is high molecular weight quaternary ammonium while the anion is halide, nitrite, nitrate, carbonate, borate, alkylborate, bicarbonate, alkanoate, phosphate, alkyl phosphate, dialkyl phosphate, dialkyl dithiophosphate and the like.

U.S. 2007/0027038 teaches ionic liquids as base oils and as components which can be mixed with hydrocarbon base oils or synthetic base oils. Ionic liquids include alkylammonium salts.

U.S. Pat. No. 4,326,973 teaches quaternary ammonium succinimide salt and adds it to a 10W40 fully formulated lubricating oil where its effectiveness as a dispersant is evaluated in the Bench VC Test.

U.S. Pat. No. 4,747,971 teaches the reaction of amine-containing dispersants, such as succinimides, with fluorophosphoric acid to produce an adduct. This adduct was added to lube oil and was evaluated for its ability to passivate the dispersant against attacking fluorocarbon seals.

WO 07/055,324 teaches a synthetic lubricant comprised of a cation selected from the group consisting of imidazolium cation, pyridinium cation, quaternary ammonium cation, quaternary phosphonium cation and a bis(fluorosulfonyl)imide anion.

JP 2006/351856 is directed to ionic liquid used as lubricating oil. The ionic liquid is material of the formula:

$$(NC)_a\text{-}(A)_b\text{-}X\text{-}((Q)_e)\text{-}(B)_c\text{—}(CN)_d$$

where X is boron, carbon, nitrogen, oxygen, aluminum, silicon, phosphorus, sulfur, arsenic or selenium, Q is an organic group, A is an integer greater than zero, and (b) to (e) are integers including zero.

DESCRIPTION OF THE INVENTION

The present invention is directed to reducing friction and wear in internal combustion engines lubricated with lubricating oil by the addition to the lubricating oil of an additive amount of one or more ionic liquids.

By additive amount of ionic liquid(s) is meant for the present invention an amount of ionic liquid(s) in an amount in the range of about 0.01 to 5.00 wt %, preferably an amount in the range of about 0.1 to 1.50 wt %, more preferably about 0.1 to 0.5 wt % based on the total weight of the lubricating oil formulation.

Ionic liquids are salts formed of a cation and an anion, the bond being an ionic bond.

The ionic liquids used as additives in the present invention comprise one or more cations ionically bonded to one or more anions.

Typical suitable cations may be represented by the formulae:

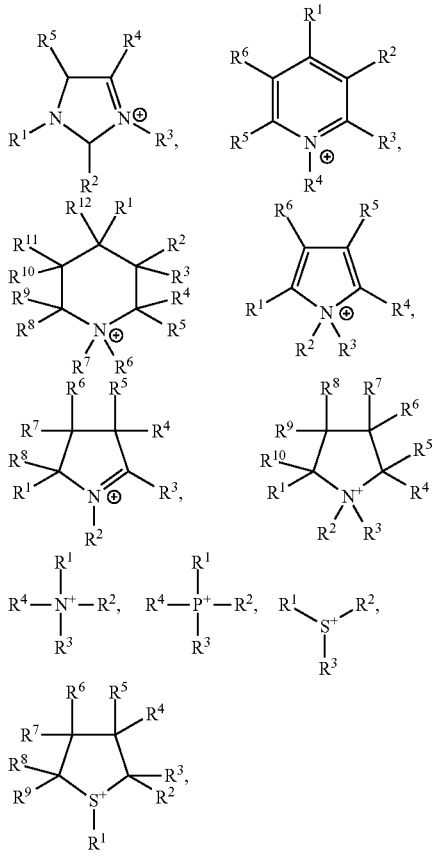

-continued

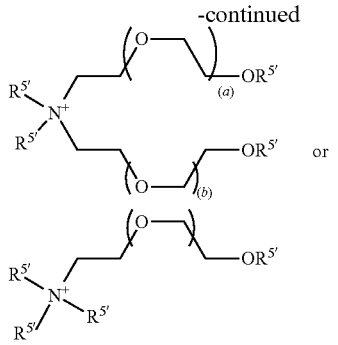

wherein each of $R^1$ to $R^{12}$ may be the same or different and are selected from the group consisting of hydrogen, —OH, $C_1$ to $C_{16}$ alkyl group(s), $C_2$ to $C_8$ alkenyl group(s) wherein the alkyl or alkenyl group(s) may contain heteroatom substituent groups selected from —CN, —$SO_3H$, —OH; $C_1$ to $C_8$ fluorocarbon group(s), $C_6$ to $C_{10}$ aryl group(s), $C_7$ to $C_{12}$ arylalkyl group(s), $C_7$ to $C_{12}$ alkylaryl group(s), all of which group(s) may have an ether bond, $C_1$ to $C_8$ alkoxy group(s), and wherein $R^{5'}$s are the same or different and are selected from hydrogen, $C_1$ to $C_{10}$ alkyl, $C_1$ to $C_{10}$ hydroxyalkyl, $C_6$ to $C_{10}$ aryl, $C_7$ to $C_{12}$ arylalkyl, $C_7$ to $C_{12}$ alkylaryl and (a), (b) and (c) are integers ranging from 1 to 30, preferably 1 to 10, and mixtures of such cations.

Preferably, the cations are selected from one or more of the group consisting of:

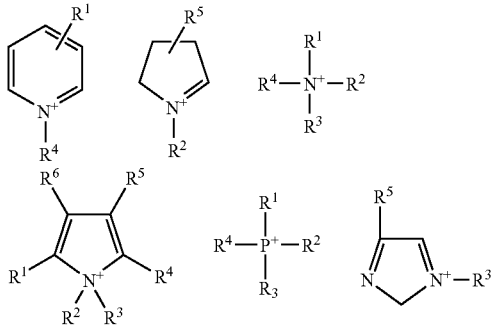

wherein $R^1$, $R^2$, $R^3$, $R^4$, $R^5$ and $R^6$ may be the same or different and are selected from the group consisting of hydrogen, $C_1$ to $C_8$ alkyl groups, $C_6$ to $C_{10}$ aryl groups, $C_7$ to $C_{12}$ arylalkyl or $C_7$ to $C_{12}$ alkylaryl groups, preferably $C_1$ to $C_4$ alkyl groups and $C_6$ aryl groups.

Most preferably the cations are selected from one or more of the group consisting of:

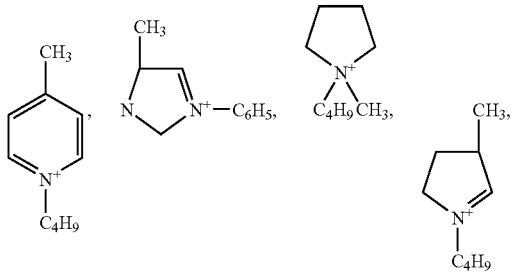

-continued

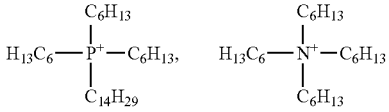

The anion is selected from the group consisting of $BX_4^-$, $Al_2X_y^-$, $Ga_2X_7^-$, $PX_6^-$ wherein X is halogen, preferably fluorine or bromine, most preferably fluorine, $R^{17}OSO_3^-$, $R^{17}SO_3^-$, $SO_4^{-2}$, $PO_4^{-3}$, $NO_3^-$, $(CN)_2N^-$, $R^{17}{}_2PO_4^-$, $R^{18}COO^-$, $R^{17}OCOO^-$, $R^{18}PO_2^-$, $SCN^-$, $HO(R^{18})COO^-$, $HS(R^{18})COO^-$, $R^{18}S^-$, $(C_nF_{(2n+1-x)}H_x)SO_3^-$, $(C_nF_{(2n+1-x)}H_x)COO^-$, $F(HF)_n^-$, $((C_nF_{(2n+1-x)}H_x)Y'O_z)_3C^-$, $((C_nF_{(2n+1-n)}H_x)Y'O_z)_2N^-$ (wherein Y' is a carbon atom or a sulfur atom; when more than a single Y' is present they may be the same or different from one another, a plurality of $(C_nF_{(2n+1-n)}H_x)Y'O_z$ groups may be the same or different from one another), n is an integer, x is an integer of 0 to 13, z is an integer of 1 to 3 when Y' is a carbon atom and 0 to 4 when Y' is a sulfur atom, $B(C_mY''_{(2m+1)4})^-$, $P(C_mY''_{(2m+1)})_6^-$ wherein Y" is a hydrogen atom or a fluorine atom wherein when a plurality of Y"s are present they may be the same or different from one another, a plurality of $(C_mY''_{(2m+1)})$ groups may be the same or different from one another, m is an integer of 0 to 6, $R^{17}$ is hydrogen, $C_1$ to $C_{10}$ alkyl, $C_6$ to $C_{10}$ aryl, or alkyl or alkylaryl, $R^{18}$ is $C_1$ to $C_{10}$ alkyl, $C_6$ to $C_{10}$ aryl, $C_6$ to $C_{12}$ arylalkyl or $C_7$ to $C_{12}$ alkylaryl,

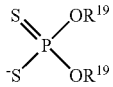

where $R^{19}$ is $C_1$ to $C_{22}$ alkyl,

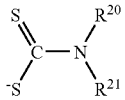

wherein $R^{20}$ and $R^{21}$ may be the same or different and selected from hydrogen or $C_1$ to $C_{22}$ alkyl, anion of the formula:

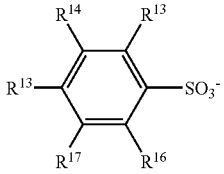

wherein each of $R^{13}$ to $R^{16}$ may be the same or different from one another and is/are groups selected from $(C_nF_{(2n+1-x)}H_x)$ wherein n and x are as previously defined, and

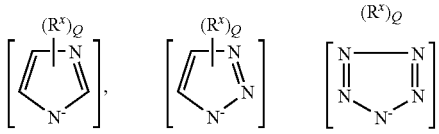

diazolate triazolate tetrazolate wherein $R^x$ is H or $C_1$ to $C_{12}$ hydrocarbyl, preferably H or $C_1$ to $C_6$ hydrocarbyl and Q is the number of available carbons in the ring, di$C_2$-$C_{20}$ alkyl dithiophosphate, di$C_2$-$C_{20}$ alkyl dithiocarbamate and mixtures of such anions.

Preferably the anions are selected from one or more of the group consisting of tetrafluoroborate, hexafluorophosphate, bis(trifluoromethyl sulfonyl imide,

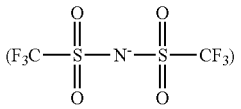

di($C_3$-$C_{12}$ alkyl) dithiophosphate, di($C_3C_{12}$ alkyl) dithiocarbamate.

The lubricating oil to which the ionic liquids can be added is any lubricating oil comprising one or more base stocks(s) or base oil(s) selected from natural or synthetic base stock(s) or base oil(s) boiling in the lubricating oil boiling range of between about 100 to 450° C. In the present specification the terms base oil(s) and base stock(s) are used interchangeably.

A wide range of lubricating base oils is known in the art. Lubricating base oils are both natural oils and synthetic oils. Natural and synthetic oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used.

Groups I, II, III, IV and V are broad categories, of base oil stocks developed and defined by the American Petroleum Institute (API Publication 1509; www.API.org) to create guidelines for lubricant base oils. Group I base stocks generally have a viscosity index of between about 80 to 120 and contain greater than about 0.03% sulfur and/or less than about 90% saturates. Group II base stocks generally have a viscosity index of between about 80 to 120, and contain less than or equal to about 0.03% sulfur and greater than or equal to about 90% saturates. Group III stocks generally have a viscosity index greater than about 120 and contain less than or equal, to about 0.03% sulfur and greater than about 90% saturates. Group IV includes polyalphaolefins (PAO). Group V base stock includes base stocks not included in Groups I-IV. The table below summarizes properties of each of these five groups.

Base Oil Properties

| | Saturates | Sulfur | Viscosity Index |
|---|---|---|---|
| Group I | <90 and/or | >0.03% and | ≧80 and <120 |
| Group II | ≧90 and | ≦0.03% and | ≧80 and <120 |
| Group III | ≧90 and | ≦0.03% and | ≧120 |

-continued

Base Oil Properties

| | Saturates | Sulfur | Viscosity Index |
|---|---|---|---|
| Group IV | Includes polyalphaolefins (PAO) and GTL products | | |
| Group V | All other base oil stocks not included in Groups I, II, III or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source; for example, as to whether they are paraffinic, naphthenic, or mixed paraffinic-naphthenic. Oils derived from coal or shale are also useful. Natural oils vary also as to the method used for their production and purification; for example, their distillation range and whether they are straight run or cracked, hydrorefined, or solvent extracted.

Group II and/or Group III hydroprocessed or hydrocracked base stocks, including synthetic oils such as polyalphaolefins, alkyl aromatics and synthetic esters are also well known base stock oils.

Synthetic oils include hydrocarbon oil such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are a commonly used synthetic hydrocarbon oil. By way of example, PAOs derived from $C_8$, $C_{10}$, $C_{12}$, $C_{14}$ olefins or mixtures thereof may be utilized. See U.S. Pat. Nos. 4,956,122; 4,827,064; and 4,827,073, which are incorporated herein by reference in their entirety.

The hydrocarbyl aromatics can be used as base oil or base oil component and can be any hydrocarbyl molecule that contains at least about 5% of its weight derived from an aromatic moiety such as a benzenoid moiety or naphthenoid moiety, or their derivatives. These hydrocarbyl aromatics include alkyl benzenes, alkyl naphthalenes, alkyl diphenyl oxides, alkyl naphthols, alkyl diphenyl sulfides, alkylated bis-phenol A, alkylated thiodiphenol, and the like. The aromatics can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from about $C_6$ up to about $C_{60}$ with a range of about $C_8$ to about $C_{40}$ often being preferred. A mixture of hydrocarbyl groups is often preferred. The hydrocarbyl group can optionally contain sulfur, oxygen, and/or nitrogen containing substituents. The aromatic group can also be derived from natural (petroleum) sources, provided at least about 5% of the molecule is comprised of an above-type aromatic moiety. Viscosities at 100° C. of approximately 3 cSt to about 50 cSt are preferred, with viscosities of approximately 3.4 cSt to about 20 cSt often being more preferred for the hydrocarbyl aromatic component. Naphthalene or methyl naphthalene, for example, can be alkylated with olefins such as octene, decene, dodecene, tetradecene or higher, mixtures of similar olefins, and the like. Useful concentrations of hydrocarbyl aromatic in a lubricant oil composition can be about 2% to about 25%, preferably about 4% to about 20%, and more preferably about 4% to about 15%, depending on the application.

Esters comprise a useful base stock. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols (such as the neopentyl polyols; e.g., neopentyl glycol, trimethylol ethane, 2-methyl-2-propyl-1,3-propanediol, trimethylol propane, pentaerythritol and dipentaerythritol) with alkanoic acids containing at least about 4 carbon atoms, preferably $C_5$ to $C_{30}$ acids such as saturated straight chain fatty acids including caprylic acid, capric acids, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from about 5 to about 10 carbon atoms. These esters are widely available commercially; for example, the Mobil P-41 and P-51 esters of ExxonMobil Chemical Company.

Non-conventional or unconventional base stocks and/or base oils include one or a mixture of base stock(s) and/or base oil(s) derived from: (1) one or more Gas-to-Liquids (GTL) materials, as well as; (2) hydrodewaxed, or hydroisomerized/cat (and/or solvent) dewaxed base stock(s) and/or base oils derived from synthetic wax, natural wax or waxy feeds, mineral and/or non-mineral oil waxy feed stocks such as gas oils, slack waxes (derived from the solvent dewaxing of natural oils, mineral oils or synthetic; e.g., Fischer-Tropsch feed stocks), natural waxes, and waxy stocks such as gas oils, waxy fuels hydrocracker bottoms, waxy raffinate, hydrocrackate, thermal crackates, foots oil or other mineral, mineral oil, or even non-petroleum oil derived waxy materials such as waxy materials received from coal liquefaction or shale oil, linear or branched hydrocarbyl compounds with carbon number of about 20 or greater, preferably about 30 or greater and mixtures of such base stocks and/or base oils.

GTL materials are materials that are derived via one or more synthesis, combination, transformation, rearrangement, and/or degradation/deconstructive processes from gaseous carbon-containing compounds, hydrogen-containing to compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material derived base stock(s) and/or base oil(s), are characterized typically as having kinematic viscosities at 100° C. of from about 2 $mm^2/s$ to about 50 $mm^2/s$ (ASTM D445). They are further characterized typically as having pour points of −5° C. to about −40° C. or lower (ASTM D97). They are also characterized typically as having viscosity indices of about 80 to about 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than about 10 ppm, and more typically less than about 5 ppm of each of these elements. The sulfur and nitrogen content of GTL base stock(s) and/or base oil(s) obtained from F-T material, especially F-T wax, is essentially nil. In addition, the absence of phosphorous and aromatics make this materially especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived is preferably an F-T material (i.e., hydrocarbons, waxy hydrocarbons, wax).

The lubricating oils to which the ionic liquid anti-friction/anti-wear additive(s) is/are added also contain an additive amount of one or more performance additives selected from detergents, dispersants, phenolic anti-oxidants, aminic anti-oxidants, other anti-wear additives, and may also contain pour point depressants, corrosion inhibitors, seal compatibility additives, anti-foam additives, inhibitors, metal deactivators, anti-rust additives, other friction modifiers, etc., all of which are materials already well known to the practitioner skilled in the art and documented in LUBRICANTS AND RELATED PRODUCTS by Klamann, Verlag Chemie, Deerfield Beach, Fla. (ISBN 0-89573-177-0), "Lubricant Additives" by M. W. Ranney, Noges Data Corporation, Parkridge, N.J. (1978) and "Lubricant Additives", C. V. Smaltheer and R. K. Smith, Legiers-Helen Company, Cleveland, Ohio (1967).

The ionic liquid can be added to the base stock and/or base oil as such or to formulated lubricants comprising base stocks/base oils and at least one additional performance additive.

When the lubricating oil is a formulated oil which contains at least one of zinc or molybdenum, dialkyl dithiophosphate or zinc or molybdenum dialkyl dithiocarbamate, preferably zinc dialkyl dithiophosphate (ZDDP) or molybdenum dialkyl dithiocarbamate (MoDTC), the anti-wear/anti-friction effect on the ionic liquid is unexpectedly increased when the ionic liquid is premixed with the zinc or molybdenum dialkyl dithiophosphate or zinc or molybdenum dialkyl dithiocarbamate prior to addition to the lubricating oil; that is, the ionic liquid and the ZDDP or MoDTC are mixed together and added as a premix to the lubricating oil. The alkyl groups can be the same or different and can be selected from $C_3$ to $C_{12}$ primary or secondary alkyl groups, preferably they are secondary alkyl groups. Premixing can be accomplished by simply adding the ionic liquid and the zinc or molybdenum DDP or zinc or molybdenum DTC together with sufficient heating for the ionic liquid and the zinc or molybdenum DDP or DTC to react.

Preferably the ionic liquid alone is heated at from 30 to 120° C., preferably about 50° C. with slurry. To the heated solution of ionic liquid is then added the zinc or molybdenum DDP or zinc or molybdenum DTC.

The mixture is then further heated at a temperature between about 50 to 120° C., preferably about 90° C. for a time sufficient for the ionic liquid and the zinc or molybdenum DDP or DTC to interact, preferably about thirty minutes to two hours, preferably about one hour. A light brown clear solution is formed upon cooling. The ionic liquid and the zinc or molybdenum DDP or DTC can be combined in any ratio, but preferably in a ratio of 1:10 to 10:1, more preferably 1:4 to 4:1, still more preferably 1:2 to 2:1, most preferably 1:1 If it was already intended that the lubricating oil contain such zinc or molybdenum DDP or DTC material, the amount of such DDP or DTC used as premix with the ionic liquid can account for all or part of the treat level of such DDP or DTC material originally intended for addition to the lubricating oil; that is, the amount of DDP or DTC material added to the oil as premix with the ionic liquid is not in addition to or over and above the amount of DDP or DTC originally intended for addition to the oil, but less can be employed.

The amount of such premix added to the lubricating oil is an amount sufficient to add to the lubricating oil an amount of ionic liquid in the aforementioned range of about 0.01 to 5.0 wt % ionic liquid, preferably about 0.1 to 1.50 wt % ionic liquid, more preferably about 0.1 to 0.5 wt % ionic liquid based on the total weight of the lubricating oil formulation.

EXAMPLES

Example 1

A formulated 5W30 engine oil was evaluated for its anti-wear/anti-friction performance. The engine oil tested contained 9 wt % of an additive treat adpack, friction modifier, dispersant, detergent, anti-foamant, anti-oxidant, and including in the 9 wt % treat level ZDDP (at 0.1 wt %) and Moly DTC (at 0.1 wt %). To separate samples of this oil was added 0.1 wt % individually of various ionic liquids (IL) and the anti-wear/anti-friction performance of each mixture was evaluated.

The anti-wear/anti-friction performance of the oil was evaluated by subjecting the subject oil to standard HFRR laboratory test ASTM (D6079):

HFRR conditions: 2° C./minute for 75 minutes, temperature range 30 to 180° C.

Step 1: Friction #1: Friction measured during the 75 minutes with temperature rising from 30 to 180° C. at 2° C./minute.

Step 2: Friction #2: Friction measured for 60 minutes while holding temperature at 180° C.

The tests results are presented in Table 1:

TABLE 1

| | Wear Scar, micron | Friction #1 | Friction #2 |
|---|---|---|---|
| Reference Oil: 5W30 | 178 | 0.119 | 0.082 |
| 0.1 wt % of IL in Oil | | | |
| 1-butyl-4-methylperidinium tetrafluorborate | 145 | 0.097 | 0.081 |
| 1-butyl-4-methylperidinium hexafluorophosphate | 140 | 0.092 | 0.09 |
| 2-benzyl-3-methylimidazolium tetrafluroborate | 138 | 0.085 | 0.082 |
| 1-benzyl-3-methylimidazolium hexafluorophosphate | | | |
| 1-butyl-3-methylimidazolium tetrafluoroborate | | | |
| 1-butyl-1-methylpyrrolidinium tetrafluoroborate | | | |
| 1-butyl-3-methylpyrrolidinium bis(trifluoromethylsulfonyl)imide | 182 | 0.116 | 0.092 |
| trimexyltetradecylphosphonium tetrafluoroborate | | | |
| tetrabutylphosphonium tetrafluoroborate | | | |
| tetrahexylammonium tetrafluoroborate | 128 | 0.069 | 0.074 |
| 1-butyl-4-methylperidinium DDP ($C_{12}$) | 78 | 0.07 | 0.051 |
| 1-butyl-4-methylperidinium DTC ($C_{12}$) | 96 | 0.078 | 0.066 |

As can be seen, in general the presence of the ionic liquid in the lubricating oil results in the oil exhibiting wear and friction properties no worse than and in most instances significantly superior to those possessed by the original formulated oil.

Example 2

In another set of experiments the formulated 5W30 lubricant was additized with 0.1 wt % of various ionic liquids but the ionic liquids were added as premixes with either ZDDP or MoDTC. The adpack added to the 5W30 lubricating oil in the case of the examples to which the premix was added had had the ZDDP or MoDTC backed-out/omitted from the adpack so that the amount of ZDDP or MoDTC added to the oil via the ionic liquid premix would be the same as the amount of ZDDP or MoDTC present in the reference oil when no premix was present. The ZDDP used was a secondary $C_3$ to $C_6$ alkyl ZDDP while the Moly DTC was a $C_6$ alkyl Moly trimer DTC. The results are provided in Table 2:

TABLE 2

| | Premixed with ZDDP | | | Premixed with MoDTC | | |
|---|---|---|---|---|---|---|
| | Wear Scar, micron | Friction #1 | Friction #2 | Wear Scar, Micron | Friction #1 | Friction #2 |
| Reference Oil: 5W30 0.1 wt % of IL in Oil | | | | | | |
| 1-butyl-4-methylperidinium tetrafluoroborate | 124 | 0.067 | 0.056 | 136 | 0.054 | 0.050 |
| 1-butyl-4-methylperidinium hexafluorophosphate | 113 | 0.059 | 0.052 | 137 | 0.047 | 0.039 |
| 1-benzyl-3-methylimidazolium tetrafluroborate | 102 | 0.044 | 0.026 | 98 | 0.022 | 0.019 |
| 1-benzyl-3-methylimidazolium hexafluorophosphate | | | | | | |
| 1-butyl-3-methylimidazolium tetrafluoroborate | | | | | | |
| 1-butyl-1-methylpyrrolidinium tetrafluoroborate | | | | | | |
| 1-butyl-3-methylpyrrolidinium bis(trifluoromethylsulfonyl)imide | 166 | 0.088 | 0.09 | 160 | 0.064 | 0.069 |
| Trihexyltetradecylphosphonium tetrafluoroborate | | | | | | |
| Tetrabutylphosphonium tetrafluoroborate | | | | | | |
| Tetrahexylammonium tetrafluoroborate | 110 | 0.06 | 0.049 | | | |

All premixes were made by heating the ionic liquids to a temperature of about 50° C. with stirring. To that solution was added an appropriate amount of ZDDP or MoDTC to achieve a 50:50 molar ratio, and the mixture heated to 90° C. with stirring for one hour. The amount of premix added in each case was sufficient to introduce 0.1 wt % of ionic liquid per se into the lubricating oil.

Example 3

The anti-wear and anti-friction performance of a particular ionic liquid per se and as premixes in various ratios with ZDDP was also investigated. The results are presented in Table 3:

TABLE 3

| | Wear Scar, Micron | Friction #1 | Friction #2 |
|---|---|---|---|
| 1-butyl-4-methylperidinium tetrafluoroborate (NEAT) | 264 | 0.11 | 0.085 |
| 1-butyl-4-methylperidinium tetrafluorobotate + ZDDP (50:50 molar ratio) (NEAT) | 591 | 0.122 | 0.177 |
| 1-butyl-4-methylperidinium tetrafluoroborate + ZDDP (25:75 molar ratio) (NEAT) | 566 | 0.134 | 0.18 |
| 1-butyl-4-methylperidinium tetrafluoroborate + ZDDP (75:25 molar ratio) (NEAT) | 584 | 0.127 | 0.189 |
| ZDDP NEAT | 584 | 0.13 | 0.295 |

As can be seen, the ionic liquid per se and as premixes in various ratios with ZDDP when evaluated as such and not being added to lubricating oil (i.e., neat) exhibited quite severe wear scar values, and Friction #1 and Friction #2 results no better than, and as premixes, significantly inferior as compared to the 5W30 formulated oil per se (Table 1) or as additized with ionic liquid premixes (Table 2). One would not have expected ionic liquids or ionic liquid premixes which when evaluated as such exhibited poor wear scar and friction test performances to have the positive influences they exhibit when added in an additive amount to a lubricating oil formulation.

What is claimed is:

1. A method for reducing friction and wear in internal combustion engines lubricated with a lubricating oil comprising a base oil and an additive amount of at least one additive selected from anti-oxidant, anti-wear, detergent or dispersant by the addition to the lubricating oil of an additive amount of one or more ionic liquids comprising, (a) heating the ionic liquid alone to a temperature of from 30 to 120° C., (b) adding to the heated ionic liquid a zinc or molybdenum dialkyl dithiophosphate or zinc or molybdenum dialkyl dithiocarbamate, (c) heating the mixture of (b) to a temperature between 50 to 120° C. for a time sufficient for the ionic liquid and the zinc or molybdenum dialkyl dithiophosphate or dialkyl dithiocarbamate to interact, and (d) adding resulting compound from (c) into base oil to make the lubricating oil.

2. The method of claim 1 wherein the additive amount of ionic liquid(s) is in the range of about 0.01 to 5.00 wt % based on the total weight of the lubricating oil.

3. The method of claim 2 wherein the ionic liquids are salts formed of cations and anions joined through an ionic bond.

4. The method of claim 3 wherein the cations are selected from

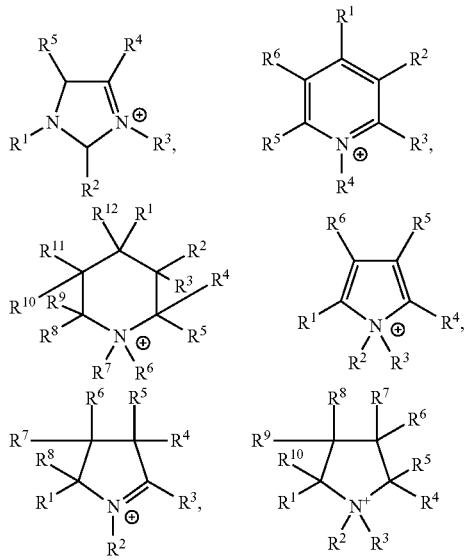

-continued

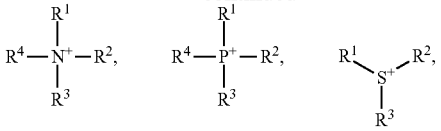

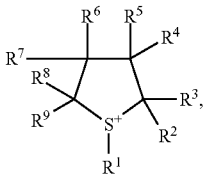

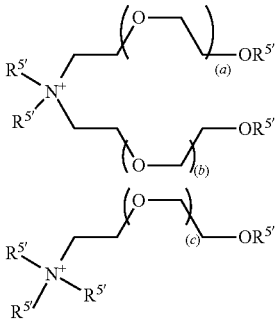

wherein each of $R^1$ to $R^{12}$ may be the same or different and are selected from the group consisting of hydrogen, —OH, $C_1$ to $C_{16}$ alkyl group(s), $C_2$ to $C_8$ alkenyl group(s) wherein the alkyl or alkenyl group(s) may contain heteroatom substituent groups selected from —CN, —$SO_3H$, —OH; $C_1$ to $C_8$ fluorocarbon group(s), $C_6$ to $C_{10}$ aryl group(s), $C_7$ to $C_{12}$ arylalkyl group(s), $C_7$ to $C_{12}$ alkylaryl group(s), all of which group(s) may have an ether bond, $C_1$ to $C_8$ alkoxy group(s), and wherein $R^{5'}$s are the same or different and are selected from hydrogen, $C_1$ to $C_{10}$ alkyl, $C_1$ to $C_{10}$ hydroxyalkyl, $C_6$ to $C_{10}$ aryl, $C_7$ to $C_{12}$ aralkyl, $C_7$ to $C_{12}$ alkaryl and (a), (b) and (c) are integers ranging from 1 to 30, preferably 1 to 10, and mixtures of such cations, and the anions are selected from the group consisting of $BX_4^-$, $Al_2X_7^-$, $Ga_2X_7^-$, $PX_6^-$ wherein X is halogen, $R^{17}OSO_3^-$, $R^{17}SO_3^-$, $SO_4^-$, $PO_4^{3}$, $NO_3^-$, $(CN)_2N^-$, $R^{17}{}_2PO_4^-$, $R^{18}COO^-$, $R^{17}OCOO^-$, $R^{18}PO_2^-$, $SCN^-$, $HO(R^{18})COO^-$, $HS(R^{18})COO^-$, $R^{18}S^-$, $(C_nF_{(2n+1-x)}H_x)SO_3^-$, $(C_nF_{(2n+1-x)}H_x)COO^-$, $F(HF)_n^-$, $((C_nF_{(2n+-x)}H_x)Y'O_z)_3C^-$, $((C_nF(_{2n+1-x})H_n)Y'O_z)_2N^-$ (wherein Y' is a carbon atom or a sulfur atom; when more than a single Y' is present they may be the same or different from one another, a plurality of $(C_nF(_{2n+1-x})H_xY'O_z$ groups may be the same or different from one another), n is an integer, x is an integer of 0 to 13, z is an integer of 1 to 3 when Y' is a carbon atom and 0 to 4 when Y' is a sulfur atom, $B(C_mY''_{(2m+1)4}^-$, $P(C_mY''_{(2m+1)6}^-$ wherein Y'' is a hydrogen atom or a fluorine atom wherein when a plurality of Y''s are present they may be the same or different from one another, a plurality of $(C_mY''_{(2m+1)})$ groups may be the same or different from one another, m is an integer of 0 to 6, $R^{17}$ is hydrogen, $C_1$ to $C_{10}$ alkyl, $C_6$ to $C_{10}$ aryl, or alkyl or alkylaryl, $R^{18}$ is $C_1$ to $C_{10}$ alkyl, $C_6$ to $C_{10}$ aryl, $C_7$ to $C_{12}$ arylalkyl or $C_7$ to $C_{12}$ alkylaryl,

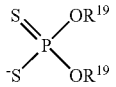

where $R^{19}$ is $C_1$ to $C_{22}$ alkyl,

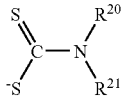

wherein $R^{20}$ and $R^{21}$ may be the same or different and selected from hydrogen or $C_1$ to $C_{22}$ alkyl, anion of the formula:

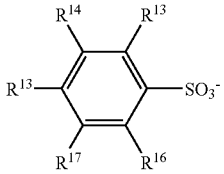

wherein each of $R^{13}$ to $R^{16}$ may be the same or different from one another and is/are groups selected from $(C_nF_{(2n+1-n)}H_x)$ wherein n and x are as previously defined, and

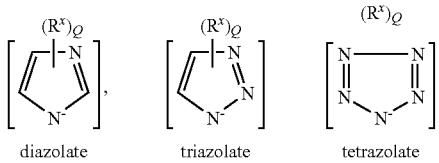

wherein $R^x$ is H or $C_1$ to $C_{12}$ hydrocarbyl, and Q is the number of available carbons in the ring, di$C_2$-$C_{20}$ alkyl dithiophosphate, di$C_2$-$C_{20}$ alkyl dithiocarbamate and mixtures of such anions.

5. The method of claim 4 wherein the cations are selected from one or more of the group consisting of:

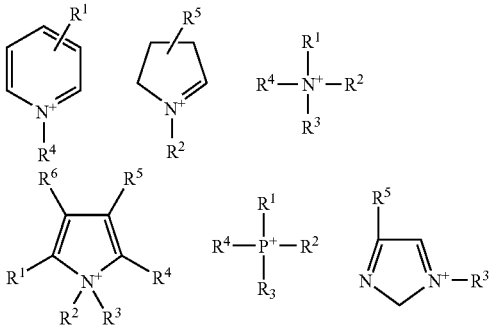

wherein $R^1$, $R^2$, $R^3$, $R^4$, $R^5$ and $R^6$ may be the same or different and are selected from the group consisting of hydrogen, $C_1$ to $C_8$ alkyl groups, $C_6$ to $C_{10}$ aryl groups, $C_7$ to $C_{12}$ arylalkyl or $C_7$ to $C_{12}$ alkylaryl groups, and the anions are selected from one or more of the group consisting of tetrafluoroborate, hexafluorophosphate, bis(trifluoromethyl sulfonyl imide,

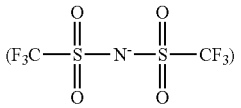

di($C_3$-$C_{12}$ alkyl) dithiophosphate, di($C_3$-$C_{12}$ alkyl) dithiocarbamate.

6. The method of claim 5 wherein the cations are selected from one or more of the group consisting of

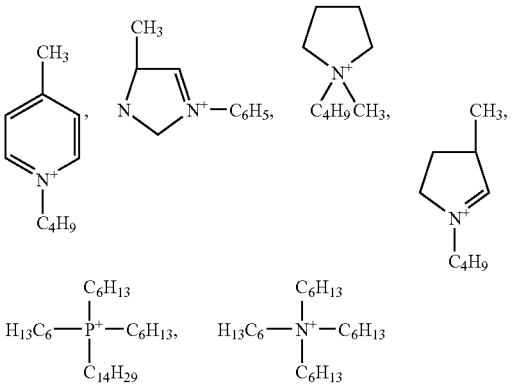

and the anions are selected from one or more of the group consisting of tetrafluoroborate, hexafluorophosphate, bis(trifluoromethyl sulfonyl imide,

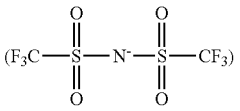

di($C_3$-$C_{12}$ alkyl) dithiophosphate, di($C_3C_{12}$ alkyl) dithiocarbamate.

7. The method of claim 1 wherein the alkyl groups of the zinc or molybdenum dialkyl dithiophosphate or zinc or molybdenum dialkyl dithiocarbamate are the same or different and are selected from $C_3$ to $C_{12}$ primary or secondary alkyl groups.

8. The method of claim 1 wherein the ionic liquid(s) and the zinc or molybdenum dialkyl dithiophosphate or zinc or molybdenum dialkyl dithiocarbamate are combined in a ratio of 1:10 to 10:1.

9. The method of claim 1 wherein the sole source of zinc or molybdenum dialkyl dithiophosphate or dialkyl dithiocarbamate in the lubricating oil is from the premix.

* * * * *